US005176538A

United States Patent [19]

Hansell, III et al.

[11] Patent Number: 5,176,538

[45] Date of Patent: Jan. 5, 1993

[54] SIGNAL INTERCONNECTOR MODULE AND ASSEMBLY THEREOF

[75] Inventors: George A. Hansell, III, Newark, Del.; David T. Humphrey, Elkton, Md.

[73] Assignee: W. L. Gore & Associates, Inc., Newark, Del.

[21] Appl. No.: 808,256

[22] Filed: Dec. 13, 1991

[51] Int. Cl.[5] ..... H01R 4/66

[52] U.S. Cl. ..... 439/607

[58] Field of Search ..... 439/607-610, 439/497

[56] References Cited

U.S. PATENT DOCUMENTS 4,601,527 7/1986 Lemke .
4,615,578 10/1986 Stadler et al. ..... 439/607
4,773,878 9/1988 Hansell .
4,824,383 4/1989 Lemke .
4,946,397 8/1990 Grasser ..... 439/607
4,990,094 2/1991 Chandler et al. ..... 439/607
5,032,089 7/1991 Hansell .

*Primary Examiner*—Joseph H. McGlynn
*Attorney, Agent, or Firm*—Dena Meyer Weker

[57] ABSTRACT

A connector module is provided which has a plurality of signal contacts and has a ground shield with spring finger ground contacts as an integral part of the shield. This module provides a high fidelity electrical path for electrical signals between flexible signal cable and a mating connector half utilizing a simple array of pins as the signal conducting means. A plurality of modules may be used in one assembly.

22 Claims, 10 Drawing Sheets

SIGNAL INTERCONNECTOR MODULE AND ASSEMBLY THEREOF

FIELD OF THE INVENTION

The present invention relates to a cable connector module having a shell with spring fingers which connects the cable grounds to ground pins of a printed circuit board or other electrical signal transmission systems, and provides for alternating signal and ground contact configurations in addition to ground planes. Various embodiments of the modules are provided.

BACKGROUND OF THE INVENTION

With the ever increasing performance of electronic devices, the demand for higher density components such as the connectors has likewise increased. Conventional cable connectors typically included an array comprising one-row of ground contacts and an adjacent row of signal contacts. Increased demand for higher densities required that these ground and signal contacts be arranged so that they were located closer to one another which resulted in an increase in crosstalk in the connector. Several alternative arrangements have been developed over the years to address those needs including alternating signal and ground contacts in a linear array which improve cross-talk performance but reduce the signal density of the connector.

Other connector designs included incorporating the ground structure within the connector for multiple conductor transmission systems in which the ground structure electrically isolates individual or groups of adjacent electrical contact elements such as that described in U.S. Pat. No. 4,773,878. In this patent, the ground structure takes the form of a shield surrounding the connector housing. U.S. Pat. No. 5,032,089 describes an advanced form of shielded connector suitable for use with coaxial cables. Both of these designs require complicated mating connectors with spring formed contacts to mate with the ground shield.

There is a need to incorporate the spring formed contacts into the ground shield so that the mating connector can be a simple array of pins. There is a need for a design that provides for tighter pin centering densities.

SUMMARY OF THE INVENTION

The present invention relates to a cable connector having a shield with integral spring fingers which connects cable grounds to ground pins of a printed circuit board or other electrical signal transmission system.

An electrical signal interconnect module is provided comprising a housing having top and bottom faces and a front and rear, said housing also having a plurality of elongate slots and a plurality of elongate cavities in which said slots are accessible to the front and at least one face of the housing and said cavities are accessible to the front and rear of the housing. The module also provides that at least one of the faces has a ground shield with a plurality of spring finger ground contacts positioned to protrude into the slots thus providing ground contact and a plurality of signal contacts positioned within the cavities and protruding beyond the rear of the housing to allow each contact to connect with a signal conductor.

Alternatively, the modules may have both the top and bottom faces having ground shields with spring finger ground contacts or having one face with a ground shield with spring finger ground contacts and the other face having a conventional ground shield.

The module may provide for the signal contacts to be arranged in one or two-rows and may have a predetermined connection configuration. A ground plane may also be provided to separate two-rows of signal contacts. Spacing between contacts may be about 0.050 inches and spacing between two-rows may be 0.050 inches or less.

A plurality of modules may be housed together in a frame to form a connector assembly. The plurality of modules may be arranged in a linear or matrix configuration. The assembly may also have dielectric material which surrounds the exterior of the modules or have dielectric material surrounding the individual modules. The dielectric material may be polytetrafluoroethylene, polyethylene or polyimide.

A connector assembly is also provided comprising a plurality of modules in a stacked array housed within a frame in which the bottom face has a ground shield with a plurality of spring finger ground contacts which serves as the top ground shield for the module directly below it.

DETAILED DESCRIPTION OF THE INVENTION

Figure 3:
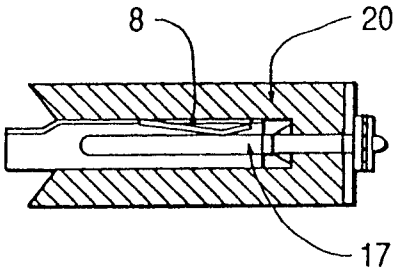
FIG. 3 is a side cutaway view of the connector shown in FIG. 1.

An electrical interconnect module is provided which mates with a pin field having a plurality of pins in a pre-designed arrangement of alternating signal and ground contacts. The mating connector module alternates socket signal contacts with ground spring fingers which are part of the ground shield. A plurality of modules of different configurations may be used in one application.

This invention is best understood by reference to the accompanying drawings. Throughout the following description, similar reference numerals refer to similar elements in all figures of the drawings.

Figure 1:
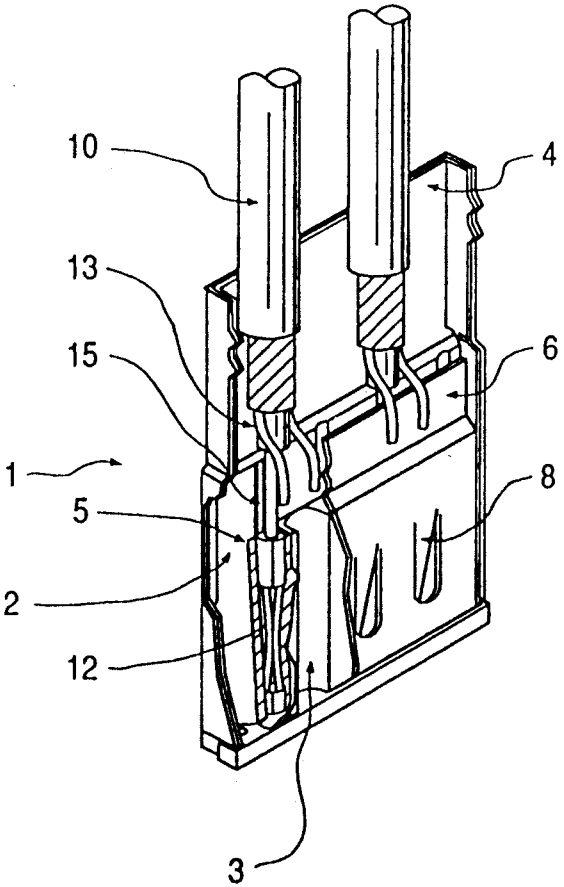
FIG. 1 is a cutaway perspective of one connector module made in accordance with the present invention.

With respect to FIG. 1, a cutaway perspective view of a connector module 1 having one-row is shown. FIG. 1 shows the plastic housing 2 having top and bottom faces and a front and rear. Also provided are a plurality of slots 3 in the housing which are accessible from the front and at least one of the faces and a plurality of cavities 5 which are accessible from the front and rear of the housing. FIG. 1 shows that the slots are found in the top face of the housing. The housing may be constructed of a stable plastic such as liquid crystal polymer or polyester.

FIG. 1 also shows that the bottom face of the housing has a ground shield 4 and that the top face of the housing has a ground shield 6 with protruding spring finger ground contacts 8 that are positioned to protrude inwardly into the slots and provide ground contacts. Although FIG. 1 shows that the spring finger ground contacts 8 are part of the top ground shield 6, the spring finger ground contacts 8 may also be formed on the bottom ground shield 6 or alternatively on both the top and bottom ground shields. The ground shields, 4 and 6 with or without the spring finger ground contacts 8 may be made from copper alloys such as beryllium copper or bronze alloys.

The spring finger ground contacts 8 are an integral part of the ground shield. They are mechanically stressed prior to ground pin insertion thus enabling them to achieve a high normal force (100 g) and ensuring reliability and environmental stability when engaged.

FIG. 1 also shows a plurality of signal contacts 12 positioned within the housing cavities 5 and protruding beyond the rear of the housing to allow each contact 12 to connect with a signal conductor 15.

FIG. 1 also shows a four beam signal contact 12 however other design contacts are also suitable. The signal conductor 15 may be attached to the signal contact 12 by either soldering or welding.

FIG. 1 also shows a cable 10 which is comprised of two ground conductors 13 and a signal conductor 15 located between the ground conductors 13. Although FIG. 1 (as well as FIGS. 4, 7, 9, and 11) show a coaxial cable with two drain wires, other coaxial cables provided with either a braid and no drain wire or with one or more drain wires are also suitable.

Figure 2:
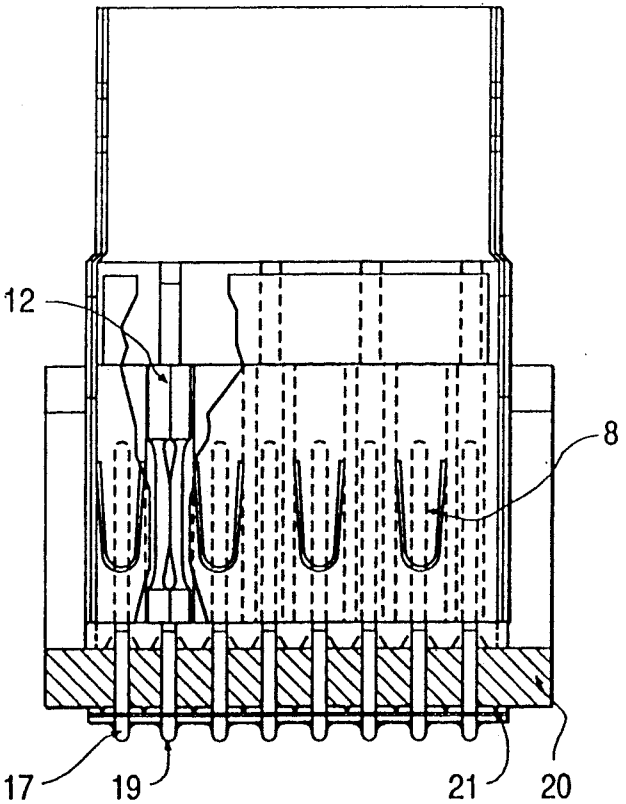
FIG. 2 is a top cutaway view of the connector shown in FIG. 1.

FIG. 2 is a front cutaway view of the embodiment shown in FIG. 1 in which the ground spring finger 8 is shown engaged with the ground pin 17. Also shown is a signal contact 12 engaged with a signal pin 19. The signal 19 and ground 17 pins are part of the header 20 that extends from the printed circuit board 21. The spacing between the signal contacts 12 and ground spring finger 8 is very small and must match the spacing of the signal and ground pins. Preferably, the spacing of pins within a row is about 0.050 inches to match the spacing of pins extending from the header and printed circuit board.

FIG. 3 shows a side cutaway view of the assembly with the header 20 and ground pins 17 which engage with a ground spring finger 8. In this embodiment, the connector has a ground to signal ratio of 1:1.

Figure 6:
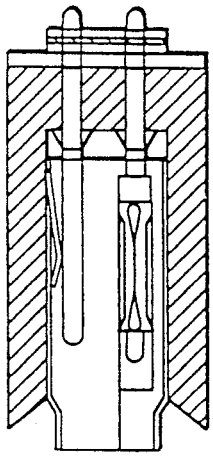
FIG. 6 is a side cutaway view of the connector shown in FIG. 4.
Figure 5:
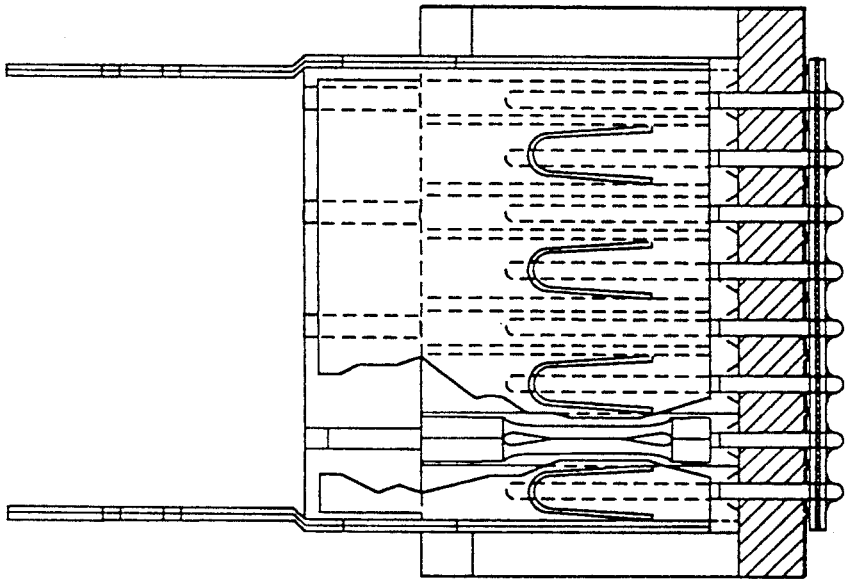
FIG. 5 is a front cutaway view of the connector shown in FIG. 4.
Figure 4:
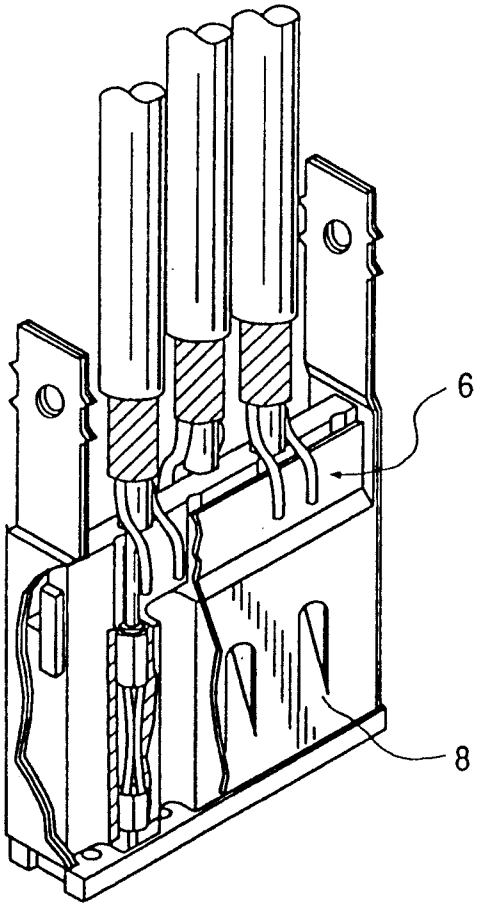
FIG. 4 is a cutaway perspective of a second embodiment of the connector module made in accordance with the present invention.

FIGS. 4 through 6 show a second embodiment of the connector module having two-rows of signals and ground contacts. The orientation of the ground spring fingers 8 is reversed from that shown in FIG. 1 and a ground plane is not present between the rows. This design allows for an increase in density however crosstalk performance is slightly compromised. By not providing a ground plane between the two-rows, mass termination techniques are achieved and fewer component parts are required. FIG. 6 shows a side cutaway view of the increased density of ground and signal contacts that are available due to the absence of the ground plane. This choice, between the two-row module without centerplane and the one-row module, is made by the balance of need for greater density versus greater crosstalk control. Spacing between the two-rows in this configuration can be 0.050 inches or less.

Figure 8:
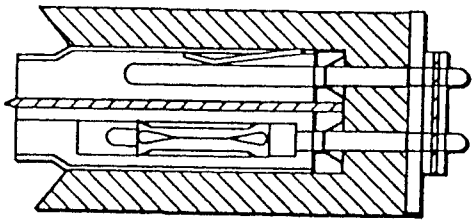
FIG. 8 is a side cutaway view of the connector shown in FIG. 7.
Figure 7:
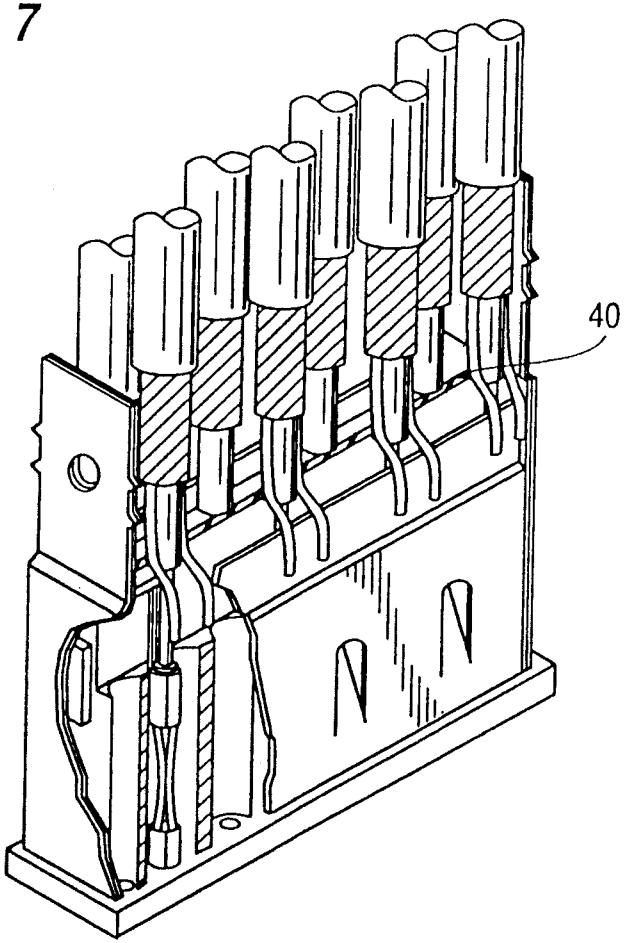
FIG. 7 is a cutaway perspective of a third embodiment of a two-row connector module with a central ground plane made in accordance with the present invention.

FIGS. 7 and 8 show a connector module having a modified ground plane 40 which extends from one side to the other side and substantially from the front of the connector module to the rear at which point the cable conductors may be attached to the connector by soldering or welding. This provides an isolative effect between signals and thereby reduces the cross-talk. Because of the presence of the ground plane, the center spacing between the rows increases.

Figure 10:
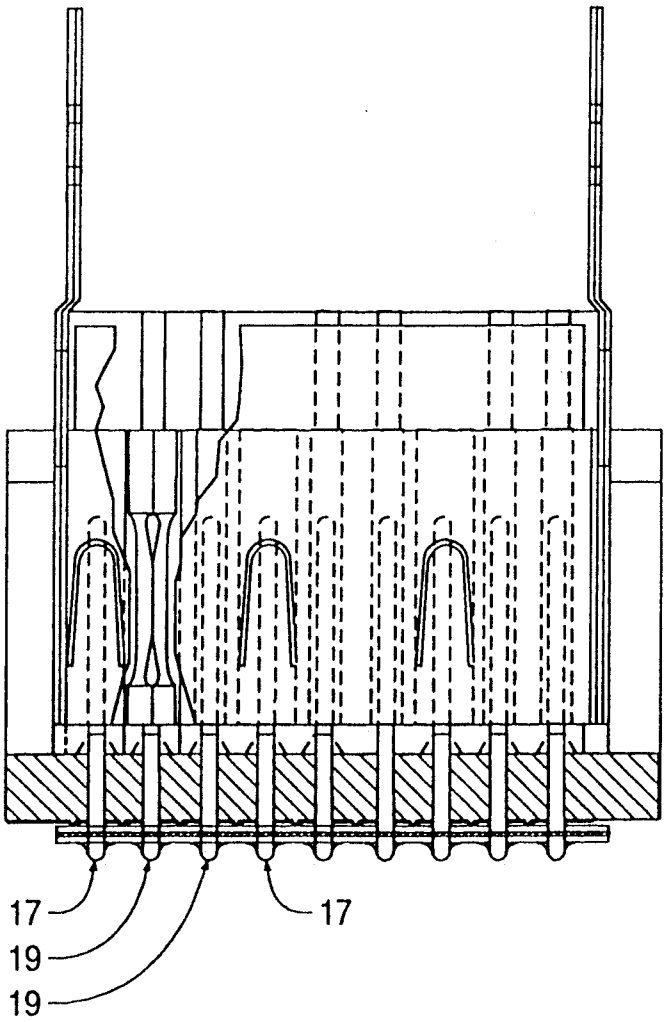
FIG. 10 is a top cutaway view of the connector shown in FIG. 9.
Figure 9:
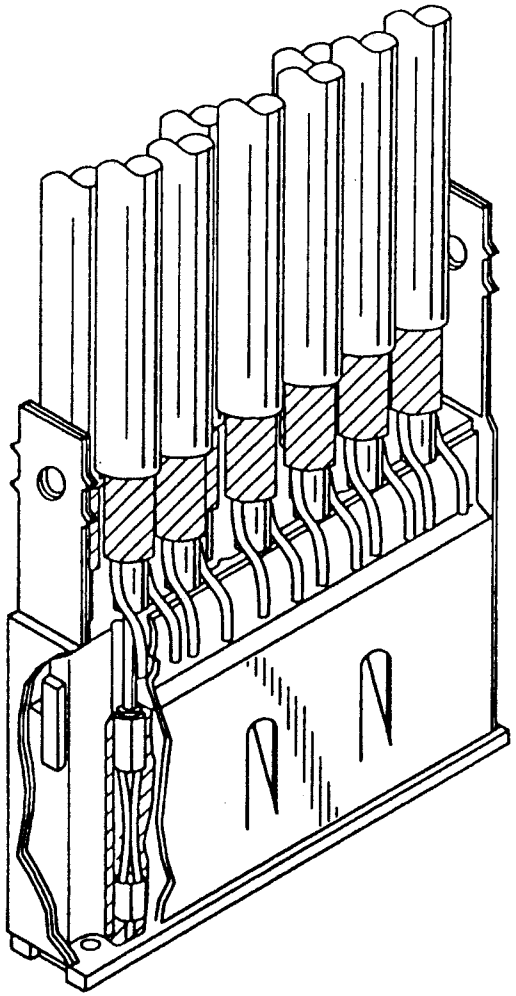
FIG. 9 is a cutaway perspective of an embodiment of the connector showing different signal to ground ratios.

FIGS. 9 and 10 show an alternate arrangement of ground and signal contacts in which the ground to signal ratio is 1:2. Similar to FIGS. 4–6, there is no ground plane however two-rows of contacts are used (as can be seen in FIG. 9).

Figure 12:
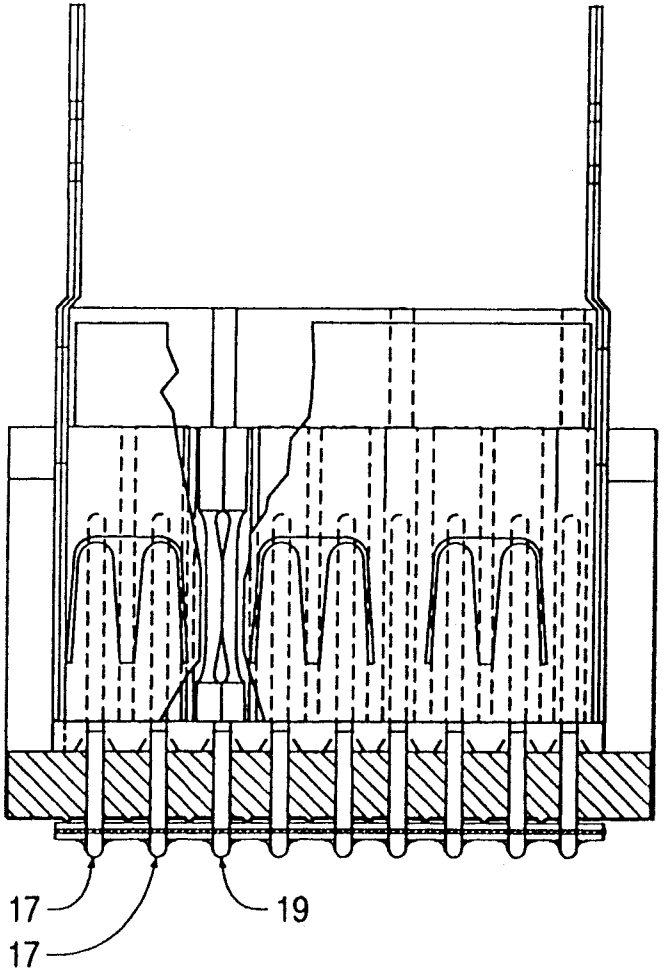
FIG. 12 is a front cutaway view of the connector shown in FIG. 11.
Figure 11:
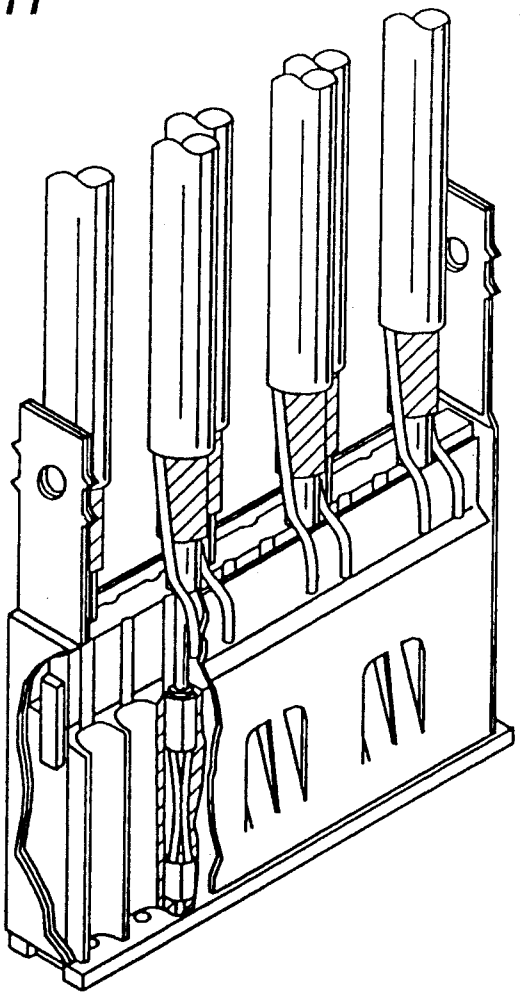
FIG. 11 is a cutaway perspective of the connector with an alternative signal to ground configuration.

FIGS. 11 and 12 show yet another arrangement of ground and signal contacts in which the ground to signal ratio is 2:1. Similar to FIGS. 4–6, there is no ground plane. In this connector embodiment however, the sequence of spring finger ground contacts 8 and signal contacts 12 is rearranged so that the spring finger ground contacts 8 are located in pairs across the connector module.

Figure 13:
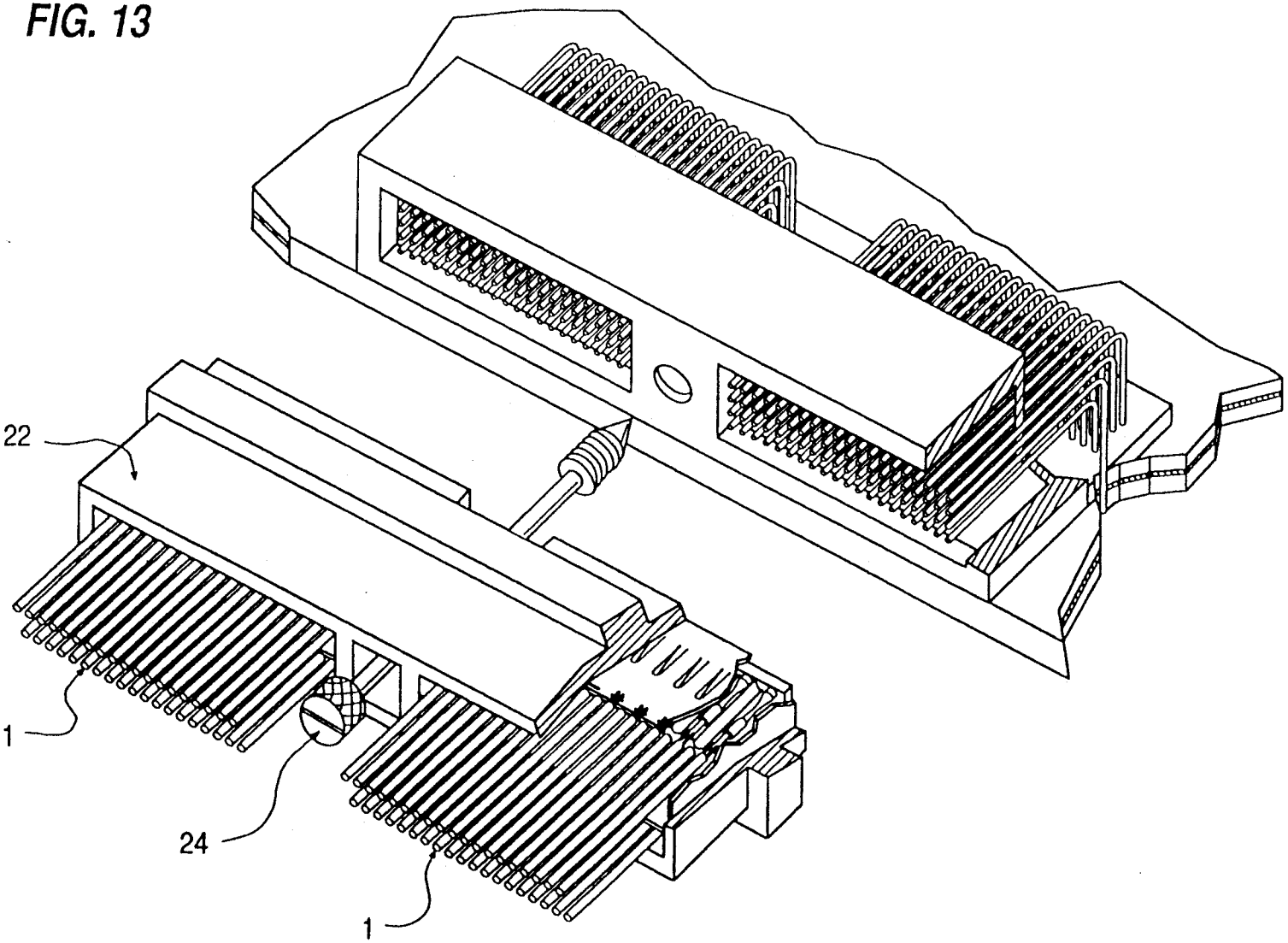
FIG. 13 is a cutaway perspective of multiple connector modules made in accordance with the present invention.

FIG. 13 is a perspective view of multiple two-row modules 1 contained within one frame 22 adapted to receive signal and ground pins extending from a right angle header of a printed circuit board. The multiple connector modules are shown here to be brought together through the mechanical aid of a jackscrew 24. Alternative means of connecting the multiple modules to the mating header include cams, latches or bale locks. The ability to combine multiple modules such as shown here provides polarization and keying in addition to providing additional mechanical strength.

Figure 14A:
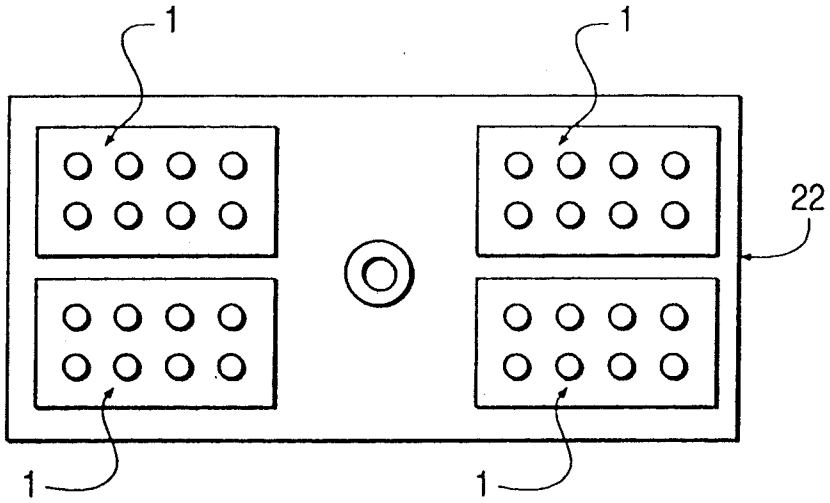
FIGS. 14*a* and 14*b* are front views of module assemblies.
Figure 14B:
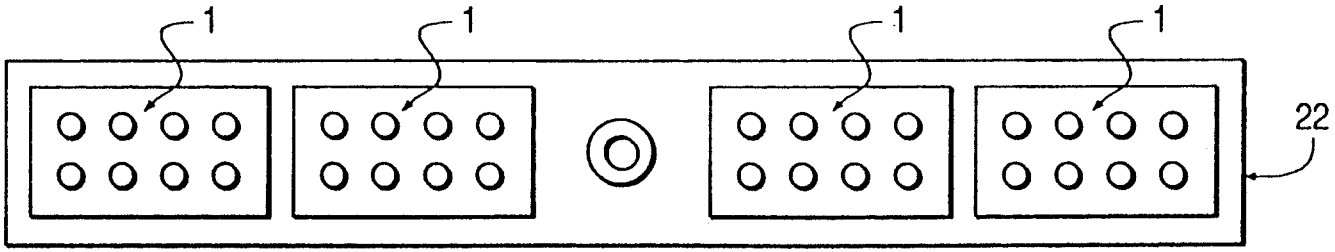

FIGS. 14*a* and 14*b* show front views of multiple two-row modules 1 arranged in different configurations. FIG. 14*a* shows a matrix configuration of four modules, two modules of which are piggy-backed onto two lower modules. Alternatively, FIG. 14*b* shows a front view of a linear array of four modules which are placed side by side adjacent to each other all contained within a frame 22.

Figure 15:
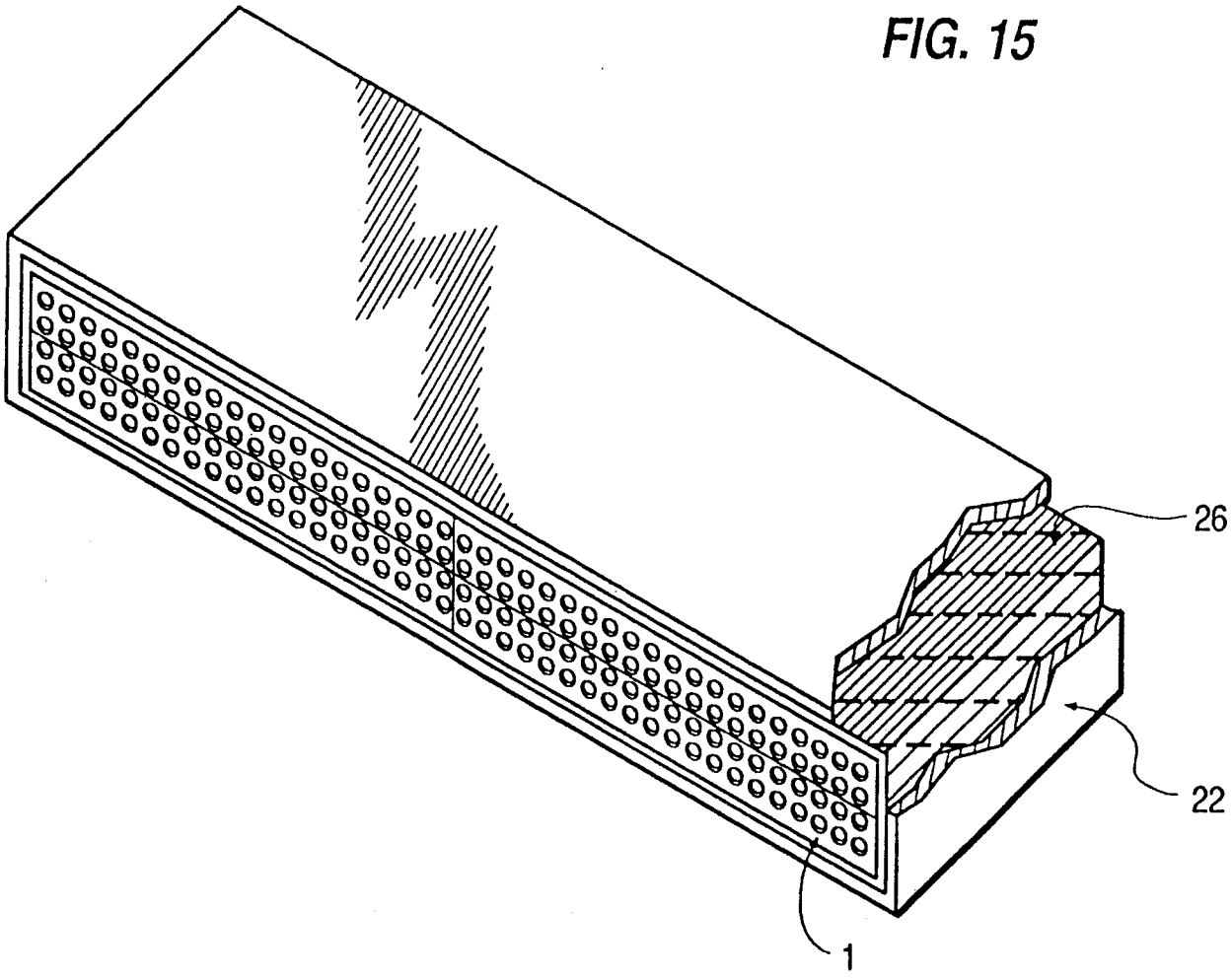
FIG. 15 is a cutaway perspective of 4 connector modules housed in a dielectric material and frame.

FIG. 15 shows an assembly of four two-row modules surrounded by a dielectric material 26. The dielectric material selected depends on the desired electrical characteristics. Suitable dielectric film materials include polytetrafluoroethylene, polyethylene terephthalate such as Mylar® commercially available from E. I. duPont de Nemours, Inc. and polyimides such as Kapton®, also available from E. I. duPont de Nemours, Inc. The assembly shown in FIG. 15 provides that the modules are electrically isolated from the frame by a dielectric material 26 but are electrically attached or commoned together. Applications using this type of configuration include situations where a chassis ground for shielding to the frame 22 and separate logic grounds on modules are desired.

Figure 16:
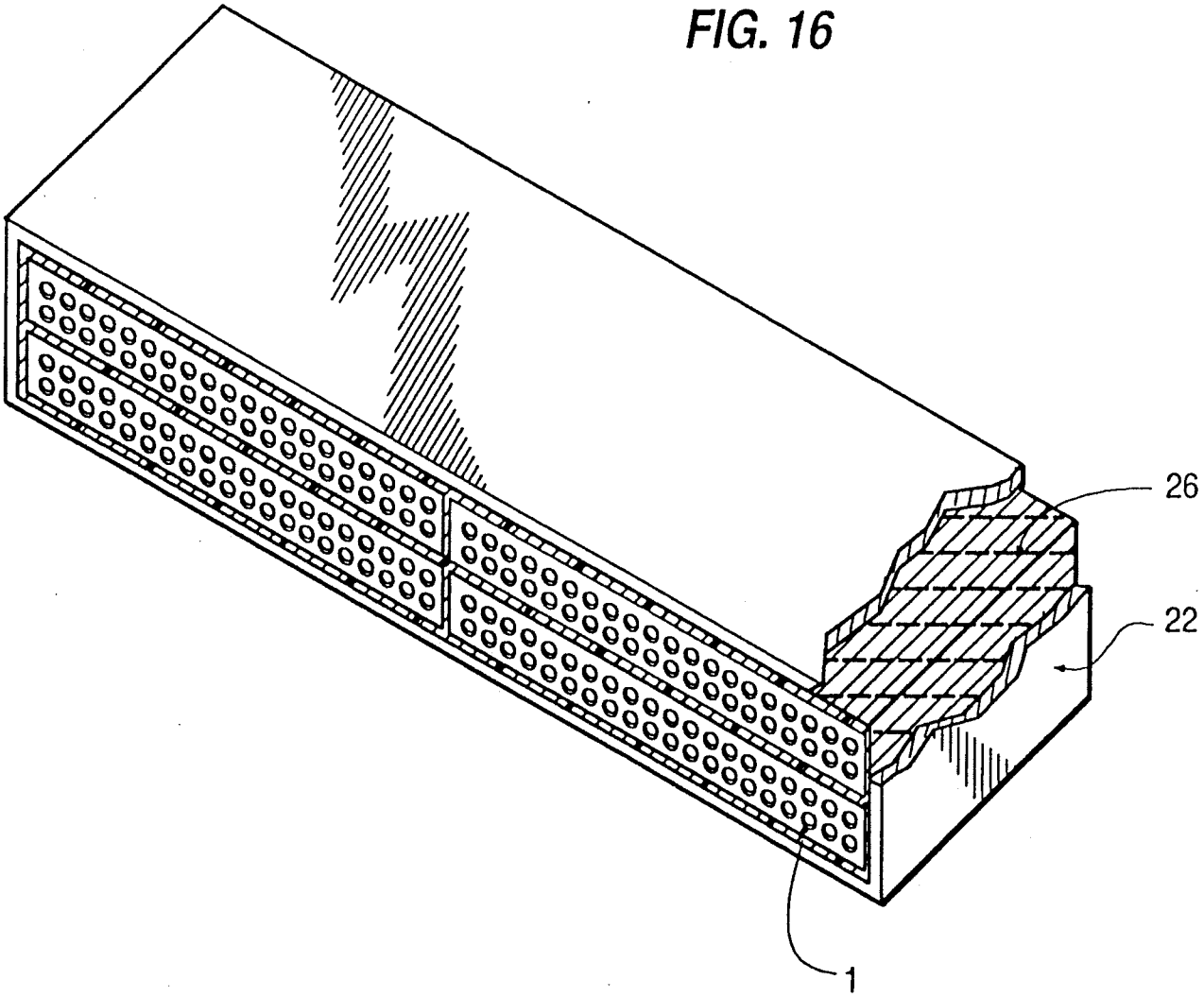
FIG. 16 is a cutaway perspective of 4 connector modules housed in a dielectric material where each module is electrically isolated from the other modules and the frame.

FIG. 16 shows yet another assembly of four two-row modules in which each module is entirely surrounded by a dielectric material 26 so that the individual modules are electrically separated from one another in addition to being separated from the frame. The dielectric materials useful for this assembly are similar to those described above. This type of assembly allows for commoning grounds within a module while isolating the separate module ground voltage levels. Applications for this type of assembly include systems having multiple digital logic families (i.e.—CMOS, TTL, ECL) and/or analog electronics within the same assembly.

Figure 17:
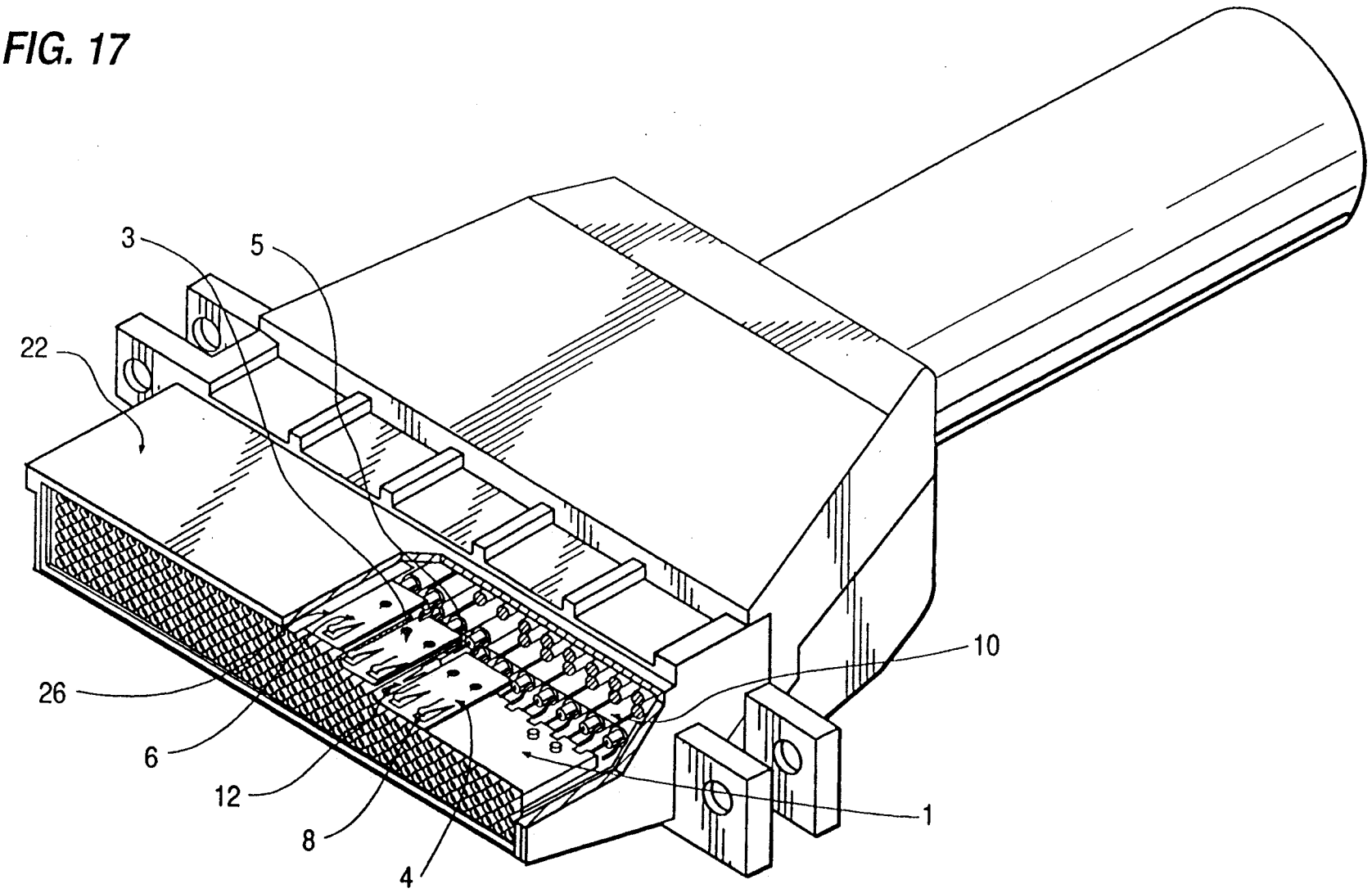
FIG. 17 is a cutaway perspective of 6 modules housed in a dielectric material and frame.

FIG. 17 is a cutaway perspective of six one-row modules 1 housed in a dielectric material 26 and frame 22. In this embodiment, five of the six modules have only a bottom ground shield 4 with integral spring fingers 8. In this stacked configuration, the bottom ground shield 4 of one module electrically becomes the top ground shield 4 of the module below it. The uppermost module has a top ground shield to complete its shield coverage.

While the invention has been disclosed herein in connection with certain embodiments and detailed description, it will be clear to one skilled in the art that modifications or variations of such details can be made without deviating from the gist of the invention and such modifications or variations are considered to be within the scope of the claims hereinbelow.

We claim:

1. An electrical signal interconnect module comprising a housing having top and bottom faces and a front and rear, a plurality of elongate slots, and a plurality of elongate cavities, said slots accessible to the front and at least one face, said cavities accessible to the front and rear of the housing; at least one of said faces has a ground shield with plurality of integrally formed spring finger ground contacts positioned to protrude into said slots and provide ground contact near the front and cable ground connection at the rear of the housing; and a plurality of signal contacts positioned within said cavities and protruding beyond the rear of the housing to allow each contact to connect with a cable signal conductor at the rear and a signal contact pin at the front.

2. An electrical signal interconnect module as in claim 1 in which both top and bottom faces of the housing have ground shields with spring finger ground contacts and slots.

3. An electrical signal interconnect module as in claim 1 in which one face has a ground shield with spring finger ground contacts and slots and the other face has a ground shield.

4. An electrical signal interconnect module as in claim 1 wherein the signal contacts are aligned in one-row.

5. An electrical signal interconnect module as in claim 1 wherein a predetermined connection configuration exists and includes a ground to signal ratio of 1:1 and wherein the ground and signal contacts alternate along the module.

6. An electrical signal interconnect module as in claim 1 wherein a predetermined connection configuration exists which includes a ground to signal ratio of 1:2 and wherein two adjacent signal contacts are located between two ground contacts.

7. An electrical signal interconnect module as in claim 1 wherein a predetermined connection configuration exists which includes a ground to signal ratio of 2:1 and wherein two adjacent ground contacts are located between two signal contacts.

8. An electrical signal interconnect module as in claim 1 wherein the spacing between contacts in a row is about 0.050 inches.

9. An electrical signal interconnect module as in claim 1 wherein the signal contacts are aligned in two-rows.

10. An electrical interconnect module as in claim 9 wherein a ground plane is provided to separate the two-rows of signal contacts.

11. An electrical signal interconnect module as in claim 9 wherein the spacing between rows of contacts is at most 0.050 inches.

12. A connector assembly comprising a plurality of electrical signal interconnect modules as described in claim 1, housed within a frame.

13. A connector assembly as in claim 12 wherein the plurality of modules are positioned in a linear arrangement.

14. A connector assembly as in claim 12 wherein the plurality of modules are positioned in a matrix arrangement.

15. A connector assembly as in claim 12 wherein the plurality of modules are electrically insulated from the frame by a dielectric material which surrounds the exterior of the plurality of modules.

16. A connector assembly as in claim 15 wherein said dielectric material is selected from the group consisting of polytetrafluoroethylene, polyethylene and polyimides.

17. A connector assembly as in claim 12 wherein the plurality of modules are electrically insulated from each other and the frame by a dielectric material which surrounds the individual modules.

18. A connector assembly in claim 17 wherein said dielectric material is selected from the group consisting of polytetrafluoroethylene, polyethylene and polyimide.

19. A connector assembly comprising a plurality of electrical signal interconnect modules stacked in an array housed within a frame, each of said modules comprising a housing with top and bottom faces and a front and rear, a plurality of elongate slots and a plurality of elongate cavities, said slots accessible to the front and the bottom face, said cavities accessible to the front and rear of the housing, wherein the bottom face has a ground shield with a plurality of integrally formed spring finger ground contacts near the front positioned to protrude into the slots and provide ground contacts and an area near the rear to allow ground conductor connection, and a plurality of signal contacts in one row positioned within said cavities and protruding beyond the rear of the housing to allow each contact to connect with a signal conductor, said modules arranged within the frame so that the bottom ground shield of one module acts as a top ground shield for the module immediately below it and the uppermost module in the array further provided with a separate top ground shield.

20. A connector assembly as described in claim 19 wherein the bottom ground shield of each module provides an electrically conductive path to the ground shield of the module directly above it in the array.

21. A connector assembly as described in claim 19 wherein the plurality of modules are electrically insulated from the frame by a dielectric material which surrounds the exterior of the plurality of modules.

22. A connector assembly as in claim 21 wherein said dielectric material is selected from the group consisting of polytetrafluoroethylene, polyethylene, and polyimide.

* * * * *

Disclaimer and Dedication 5,176,538—George A. Hansell, III, Newark, Del.; David T. Humphrey, Elkton, Md. SIGNAL INTERCONNECTOR MODULE AND ASSEMBLY THEREOF. Patent dated January 5, 1993. Disclaimer and Dedication filed November 28, 2000, by the assignee, Gore Enterprise Holdings, Inc.

Hereby disclaims and dedicates to the Public all claims and entire term of said patent.

*(Official Gazette, July 31, 2001)*